US005201276A

United States Patent [19]

Knight

[11] Patent Number: 5,201,276

[45] Date of Patent: Apr. 13, 1993

[54] POWER WHISTLE

[76] Inventor: Randy A. Knight, 11236 Purity Rd., St. Louisville, Ohio 43071

[21] Appl. No.: 805,867

[22] Filed: Dec. 10, 1991

Related U.S. Application Data

[63] Continuation-in-part of Ser. No. 509,084, Apr. 16, 1990, abandoned.

[51] Int. Cl.[5] ..... G10K 5/00

[52] U.S. Cl. ..... 116/137 R; 446/204

[58] Field of Search ..... 116/137 R, 137 A, 140, 116/141; 446/202, 204, 207, 416, 216

[56] References Cited

U.S. PATENT DOCUMENTS 733,122 7/1903 Bartholomew ..... 446/204
805,817 11/1905 Pardoe ..... 446/204

FOREIGN PATENT DOCUMENTS 0136866 4/1950 Australia ..... 446/204
0241974 11/1925 United Kingdom ..... 446/204

*Primary Examiner*—William A. Cuchlinski, Jr.
*Assistant Examiner*—W. Morris Worth
*Attorney, Agent, or Firm*—Edward E. Schilling

[57] ABSTRACT

A novel mouth whistle capable of a very loud whistle sound and comfortable to hold and use orally is shaped with a somewhat flattened hemi-oblate body with a cavity opening to the front, the back end being rounded and the front opening end being cut off substantially flat in a single plane, transverse to the upper and lower opposed walls defining the cavity. The upper and lower walls are each perforated with a single, centrally located aperture substantially coaligned and in communication with the cavity.

9 Claims, 1 Drawing Sheet

POWER WHISTLE

CROSS REFERENCE TO RELATED APPLICATION

This application is a continuation-in-part of my earlier application, Ser. No. 07/509,084, filed Apr. 16, 1990, now abandoned.

FIELD OF THE INVENTION

The invention relates to a novel mouth whistle. More particularly, it relates to the kind of whistle with a forward opening cavity defined by upper and lower walls that merge together at the sides and rear which a hole formed in the opposed walls, the holes being substantially aligned.

BACKGROUND OF THE INVENTION

Mouth whistles have been used for some time for musical as well as signal purposes.

U.S. Pat. No. 733,122, issued Jul. 7, 1903, describes a musical type mouth whistle with a horn section in front and a laterally straight, folded over, rear wall. The horn section has upper and lower walls with laterally extending apertures for engagement with the lips of the player to prevent ejection of the whistle.

U.S. Pat. No. 805,817, issued Nov. 28, 1905, also describes a whistle with an anterior horn section with ridges to assist retention in the mouth of the user and with a reed within the horn. This whistle also has a laterally straight rear wall.

British patent 241,974, granted Nov. 5, 1925, shows a mouth-held whistle formed of a metal blank of sheet metal folded upon itself, with substantially opposed holes in the upper and lower walls adjacent the rear wall, the rear wall being formed by simply bending a circular blank upon itself along substantially the diametric line. The whistle is provided with an edge closure or sidewall adjacent and connected to the lateral ends of the sidewall to form an amplifying chamber, or, the opposed edges of the upper and lower walls are ground or cut away adjacent the rear wall in an arcuate shape to receive a thumb and forefinger, respectively, of the user, to provide the desired side closures. The rear wall of this whistle is also defined along the straight line of the linear fold of the metal blank.

Australian patent 136,866, granted Apr. 3, 1950, shows and describes another whistle made by bending a circular or octagonal blank of sheet metal upon itself, but also by forming the opposed complementary metal walls adjacent the fold into a bulbous chamber to allegedly improve the tonal qualities of the note produced. By utilizing a springy sheet metal, the user can exercise further control of the emitted sound by pressing the upper and lower walls closer together or releasing the walls as desired. As in the other whistles described, the whistle has a liearly straight rear wall that is inserted into the mouth of the user.

SUMMARY OF THE INVENTION

The power whistle of the present invention is a forward opening mouth whistle for signaling having a hemi-oblate body with a front end, rear end and opposed sides, and, singly pierced, upper and lower walls which curve each toward the other to integrally merge or join and form a bit of sidewall and rear wall along the opposed sides and rear end along a smooth arc extending from one lateral side of the front opening around the rear of the whistle to the other lateral side of the front opening. The sidewalls and rear wall extend along the arc that may be nearly semicircular to symmetrical parabolic. The lips or margins of the front opening lie substantially in a common plane, more or less normal to the upper and lower walls. The gentle curve of the rear and sides of the whistle is comfortably received and retained in the mouth and the whistle is easily capable of generating an immensely loud signal or tone. Preferably, the whistle is made with relatively thick upper and lower walls and the curve of the upper wall to the lower wall is smooth and well rounded.

BRIEF DESCRIPTION OF THE DRAWINGS

The invention will be better understood with reference to the drawings in which.

DETAILED DESCRIPTION OF THE INVENTION

Figure 3:
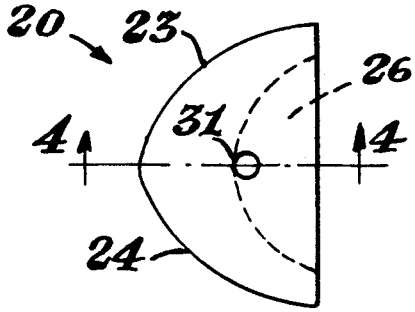
FIG. 3 is a plan view of the whistle of FIG. 1.

The power signal whistle as shown in FIGS. 1-4 is largely a solid, somewhat flattened, i.e., hemi-oblate, body 20 with a front opening cavity, the body being approximately semi-elliptical as seen in profile in side view with a flat cut front end 21, and the body narrowing to a rounded rear end 22, the narrowing being in all three dimensions. The body 20 as seen in plan view in FIG. 3 is wider than it is thick, and again, is somewhat semi-elliptical, the sides 23,24 merging smoothly into the rear 22 along a line that may vary from nearly semicircular to largely symmetrical parabolic. The body 20 is formed with a front opening cavity 26, the cavity being substantially symmetrically located within relatively thick defining opposed top and bottom walls 27,28 that merge without defining a great deal of sidewall on either side or at the rear. The front faces or lips 29, 30 at the edges of the top and bottom walls are flat, or nearly so, and lie substantially in a common plane that is more or less normal to the top and bottom walls.

Figure 1:
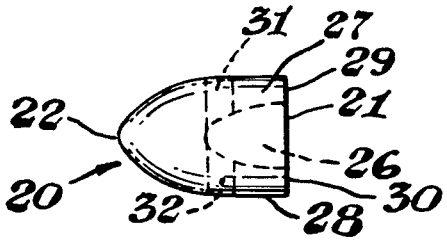
FIG. 1 is a view of the power whistle of the invention in side elevation.
Figure 2:
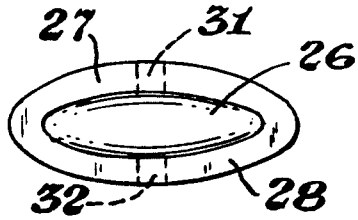
FIG. 2 is a view in front elevation of the whistle of FIG. 1.
Figure 4:
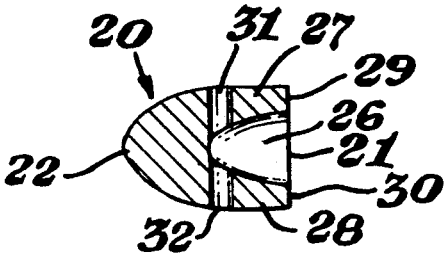
FIG. 4 is a view in section taken along the line 4—4 of FIG. 3.

The cavity 26 extends in depth only about one-half the depth of the body 20 from front 21 to back 22. The body is pierced through both the top wall 27 and the bottom wall 28 with openings 31 and 32, respectively, that are usually centrally located within the respective opposed walls and co-aligned, or approximately so, not varying from alignment more than about the width of one of the openings, or holes. In the embodiment shown, the openings 31,32 intercept the back of the cavity 26, which is seen in FIGS. 1, 3 and 4 to be elliptical along both the x and y axes, that is, the cavity wall has a flattened ellipsoidal shape in section on both the x and y axes if such were drawn on the figures. It is essential for whistling that the openings 31,32 intersect, and communicate with, cavity 26, as seen in the view in section seen in FIG. 4 and as shown in dotted lines in FIGS. 1 and 3.

Figure 5:
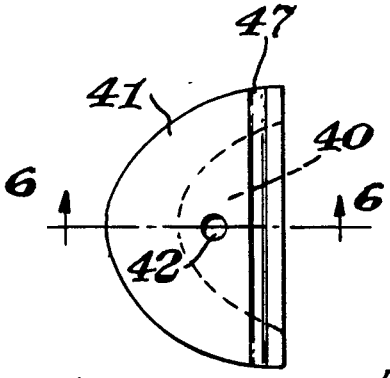
FIG. 5 is a view of another embodiment of the present whistle.
Figure 6:
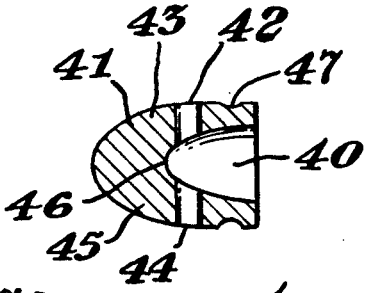
FIG. 6 is a view in section taken along the line 6—6 of FIG. 5.

If desired, the cavity 40, as seen in the embodiments shown in FIGS. 5 and 6, may extend more deeply into the body 41 than the bore of the openings 42, in the top wall 43, and 44 in the bottom wall 45, as coincidence of the backside 46 of the cavity 40 and a sidewall of either opening 42, 44 is not necessary though such coincidence is preferred.

In each case, the cavity is generally centered with respect to the thickness dimension of the whistle body, i.e., the top and bottom walls are about of equal thickness.

In order to make it easier to retain the power whistle in the mouth of the user during strenous blowing, a circumferential peripheral groove 47 may be formed or made, if desired, in the top and bottom walls 43,45 of the whistle body 41, as depicted in FIGS. 5 and 6.

The body of the whistle will generally be most comfortable for the ordinary user if the side to side dimensions at the cavity opening are in the range of about one and three-quarters to two and one-quarter inches, preferably about two inches, with the thickness of the body in the range of about five-eighths to about seven-eighths inch, preferably about three-quarters inch, and with a depth, front to back of the body, about seven-eighths to one and three-eighths inch, preferably about one and one-eighth inch. With a body about eleven-sixteenths to seven-eighths inch in thickness, the top and bottom walls at the cavity opening, if the cavity is centered, will each be about three-sixteenths inch thick and the width of the cavity opening will be about five-sixteenths to about one-half inch at the centerline of the body, preferably about three-eighths inch.

While it is preferred that the power whistle is formed with relatively thick top, bottom and rear walls, or that it is made from a firm solid body, as of soapstone or hardwood or of a solid, water-insoluble natural or synthetic polymer, the whistle may be made, if desired, from sheet metal or synthetic plastic sheet with the top and bottom walls welded, brazed or cemented or otherwise securely bonded together along a semicircular or parabolic curve demarcating the rear and sides of the whistle.

Figure 9:
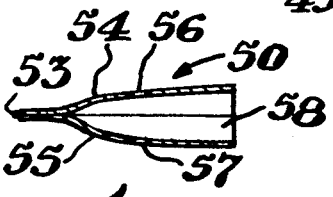
FIG. 9 is a view in section taken along line 9—9 of FIG. 7.
Figure 7:
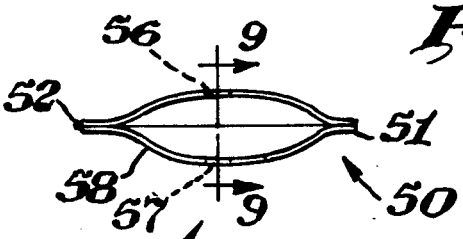
FIG. 7 is a view in front elevation of yet another embodiment of the present whistle.
Figure 8:
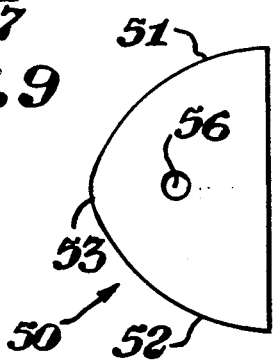
FIG. 8 is a plan view of the whistle embodiment of FIG. 7.

Referring now to FIGS. 7, 8 and 9, such a whistle 50 is seen with a substantially semicircular perimeter along the side edges 51, 52 and the rear 53. The upper and lower walls 54, 55 are seen to be relatively thin compared to the whistle of FIG. 1 and are joined at the side edges 51, 52 and at the rear 53 along the smooth semicircular perimeter. The upper and lower walls may be cut or formed to join along a parabolic line, if desired, so as to have an outline more like that of the whistle shown in FIG. 3. The upper wall 54 is drilled or otherwise pierced at a point about centrally located from front to back and side to side to provide an opening 56, while a corresponding opening 57 is made in the bottom wall 55. The two openings should be substantially aligned and should be spaced at least one-third the front to back depth of the whistle from the rear edge, preferably about one-half the depth. The openings 56, 57 into the cavity 58 should be at least one-eighth inch in diameter, and preferably at least three-sixteenths inch, and not more than five-sixteenths inch in width, preferably not more than about one-quarter inch in width. The minimum sheet material thickness is not critical, it being sufficient that the whistle be sturdy enough to maintain the integrity of the shape of the whistle in use for a useful length of time. Thus, sheet metal of, e.g., steel, may be used of a thickness of at least ten thousandths of an inch and preferably at least fifteen thousandths inch or solid synthetic plastic sheet of similar strength properties to such sheet metal, or greater, for manufacture of the present whistle from sheet materials. In this case, the dimensions of the cavity are laterally greater in extending to the edges of the joined top and bottom walls, but the span or width of the cavity opening at the centerline, i.e., between the top and bottom walls, is about the same as for the other embodiments made of thicker body material, i.e., at least about one-quarter inch, ranging up to about seven-sixteenths inch, but preferably about five-sixteenths inch to three-eighths inch width opening.

In its most preferred form the whistle has a front opening, rather flattened rounded body with a substantially flat front and a rounded rear. The perimeter of the lips of the front opening describe an ellipse with a major and a minor axis. A section taken through the major axis has a perimeter describing a curve varying from a semicircle to a parabola between the lips of the front opening, while a section taken through the minor axis has a perimeter describing a curve between the lips in the form of a slim parabola, i.e., with the arms not spread wide apart. The cavity in the preferred whistle body has approximately the same shape as the body, but with smaller dimensions, and extends far enough into the body from the front to be intercepted by the single rather centrally located aperture in each of the upper and lower walls.

What is claimed is:

1. A mouth whistle consisting of a hemi-oblate body with a front end, rear end and opposed sides and upper and lower walls curving each toward the other to merge into a bit of sidewall and rear wall along the opposed sides and rear end to define a cavity with a rear wall and opening at the front end of the body, the rear end being rounded in three dimensions and the front end being cut off substantially along a single plane transverse to the upper and lower walls, the upper and lower walls being relatively thick and each perforated by a single aperture, the apertures being substantially coaligned and in communication with the cavity.

2. The mouth whistle of claim 1 in which the upper and lower walls merge to form a bit of sidewall, the side-wall extending along a substantially semicircular line.

3. The mouth whistle of claim 1 wherein the upper and lower walls merge to form a bit of sidewall, the side-wall extending along a substantially symmetrical parabolic curve extending from one of the sides of the whistle past the rear end to the other side.

4. The mouth whistle of claim 1 wherein the apertures are substantially aligned with the rear wall of the cavity.

5. The mouth whistle of claim 1 wherein the rear wall of the cavity is spaced further from the cavity opening at the front end than the aperture in either the upper wall or the lower wall.

6. The mouth whistle of claim 1 with an external substantially circumferential groove provided therein the upper wall and the lower wall adjacent the cavity opening at the front end.

7. The mouth whistle of claim 1 with an external groove provided in at least one of the upper wall and the lower wall adjacent to but spaced apart from and substantially parallel to the front end.

8. The mouth whistle of claim 1 wherein the upper and lower walls each have a thickness of about three-sixteenths inch.

9. The mouth whistle of claim 8 wherein the body is formed of one of a carvable natural stone and a solid synthetic polymer.

* * * * *